United States Patent [19]

Boba et al.

[11] 3,953,164

[45] Apr. 27, 1976

[54] EMBOSSING OF PILE FABRICS

[75] Inventors: Joseph Boba, Fort Lee; Robert P. Conger, Park Ridge, both of N.J.

[73] Assignee: Congoleum Industries, Inc., Kearny, N.J.

[22] Filed: Oct. 29, 1974

[21] Appl. No.: 518,245

[52] U.S. Cl. ..... 8/115; 8/130.1; 8/114.5; 8/66; 8/17; 8/DIG. 21

[51] Int. Cl.[2] ..... B63H 9/04

[58] Field of Search ..... 8/17, 114.5, 115, 130.1, 8/66, DIG. 21

[56] References Cited

UNITED STATES PATENTS 2,020,303 11/1935 Dreyfus ..... 8/115 X 2,110,866 3/1938 Castles ..... 28/1

FOREIGN PATENTS OR APPLICATIONS 544,820 4/1942 United Kingdom ..... 8/114.5

*Primary Examiner*—Carman J. Seccuro

*Attorney, Agent, or Firm*—Richard T. Laughlin

[57] ABSTRACT

An improved process of developing an embossed effect in nylon pile fabric, particularly carpet, that comprises selectively contacting the pile surface of the foregoing fabric with a chemical fiber shrinking agent in combination with a penetrant vehicle capable of increasing materially the penetration of the shrinking agent into the fibre surface, and, correspondingly, the depth of embossing caused by the shrinking agent's action in reducing the length of the treated pile.

14 Claims, 2 Drawing Figures

EMBOSSING OF PILE FABRICS

RELATED APPLICATIONS

Other applications related to this technology are:

Palmer et al Ser. 386,037 filed Aug. 6, 1973 now U.S. Pat. No. 3,849,158 granted Nov. 19, 1974

Palmer et al Ser. 386,047 filed Aug. 6, 1973 now U.S. Pat. No. 3,849,157 granted Nov. 19, 1974

Palmer et al Ser. 386,048 filed Aug. 6, 1973 now U.S. Pat. No. 3,849,159 granted Nov. 19, 1974

Ehrenfeld Jr. et al Ser. 437,782 filed Jan. 30, 1974 now abandoned, continued as Ser. No. 632,446 filed Nov. 17, 1975

Assigned to the same assignee and are to be considered fully incorporated herein.

BACKGROUND OF THE INVENTION

In the production of nylon pile fibers, it is often desirable to emboss the surface thereof in order to provide added decorative appeal. In some instances, the embossed areas are printed with dyes to further embellish the surface design.

Embossing of pile fabrics is conventionally accomplished with a heat embossing roll or plate which has been engraved or otherwise treated to create the design desired in raised relief on the surface. A method which eliminates the use of embossing rolls has been disclosed in U.S. Pat. Nos. 2,790,255 and 2,875,504. In accordance with these patents, the pile fabric is formed from a combination of shrinkable and non-shrinkable yarns. Upon subjecting the fabric to the influence of heat, the pile formed from the shrinkable yarns contracts while the base and non-shrinkable yarns remain intact thereby yielding a pile made of a high and low areas to give the appearance of an embossed or carved product.

A chemical embossing method is disclosed in U.S. Pat. No. 2,020,698. Acccording to this patent, fabric having a pile of organic ester of cellulose yarn is locally treated with an alkali or alkaline salt saponifying agent in order to obtain ornamental differential effects in the treated areas. Furthermore, since the organic ester of cellulose pile yarns that have not been saponified are more difficult to change from their position, after they are once set than are the saponified organic ester of cellulose yarns, it is possible to obtain a differential lay between the saponified and unsaponified organic ester of cellulose pile yarn. Thus, the fabric, after the application of the saponifying agent, may be washed, finished and dried with the pile erect, after which the fabric may be run through water and brushed across the peice to lay the pile towards the selvage and it is then dried. This causes the saponified pile yarn to lie flat while the unsaponified yarn remains substantially erect. Upon subsequent steaming and brushing the fabric in the opposite direction, any unsaponified yarn which may have been slightly bent from the vertical by the previous brushing toward the selvage is caused to stand erect without disturbing the position of the laid or crushed saponified organic ester of cellulose pile yarn.

SUMMARY OF THE INVENTION

It is a primary object of this invention to provide a process for embossing the surface of nylon pile fabric to a significant pre-determined depth using minimal amounts of embossing or shrinking agent.

Another object is to provide such a process which is readily adaptable to the standard printing equipment.

Another object is to provide a process which allows the production of pile fabric having embossed areas where desired in register with a printed design.

Various other subjects and advantages of this invention will be apparent from the following detailed description thereof.

It has now been discovered that it is possible to produce superior nylon fabrics having embossed surfaces by contacting selected portions of the surfaces with a combination of a considerably lower concentration of a chemical embossing agent for the fibers of said pile fabrics and certain organic chemicals. We believe each of these organic chemicals acts as a penetrant vehicle which facilitates the penetration of the embossing agent into the fiber of the pile fabric, causing dimensional change by linear contraction of the treated fibers and, thereafter, effectively removing the embossing agent and penetrant. The resulting product is thus depressed or recessed to a significant and definable extent in the treated areas.

The term "penetrant or penetrant vehicle," as employed herein, is intended to encompass agents which provide increased depth of penetration of embossing agents into the nylon fiber.

The embossing composition can be transparent so that the appearance of the product is not altered other than in being embossed. Alternatively, the embossing agent and penetrant vehicle can be part of a dye or pigment composition used in printing the fabric so that the color appears in perfect register in the areas of embossing agent application.

The depth of the depressed areas that can be attained will vary ordinarily with the components, the relative concentration of the components of the embossing composition, and the strength of the combination of embossing agents incorporated in the vehicle. Additional factors affecting embossing include the elevated temperatures at which embossing occurs and the periods of exposure of the fabric treated to such temperatures.

It has now been discovered that unexpectedly deep penetration can be attained by embossing agents under controlled conditions where penetrant agent or vehicle, in accordance with the invention, is incorporated in the embossing composition.

This discovery makes possible the production of a product having enhanced embossed surfaces utilizing minimal concentrations of embossing agent which can be in complete register with a printed design. This discovery makes possible also the utilization of many types of printing apparatus which may be employed at standard printing speeds for purposes of effecting embossing in a single pass, thereby eliminating the need for expensive embossing equipment or extended periods of time to secure a satisfactory embossing effect. Further, it allows the embossing of a surface without exerting sufficient pressure to permanently deform the pile fabric. A great number of products can be produced by the process. They can be used for floor, wall and ceiling coverings, drapery, upholstery and the like, and, in fact, wherever pile fabrics are utilized. They are readily adaptable to decorating any surface on which pile fabrics can be applied. Many additional application will occur to those skilled in the art.

This invention will be better understood from the following detailed description thereof together with the accompanying self-explanatory drawings in which:

FIG. 1 is an enlarged top view of a section of an embossed product of this invention; and, FIG. 2 is an enlarged cross-sectional view of the same product taken through line 2—2.

DESCRIPTION OF THE PREFERRED EMBODIMENTS

Figure 1:
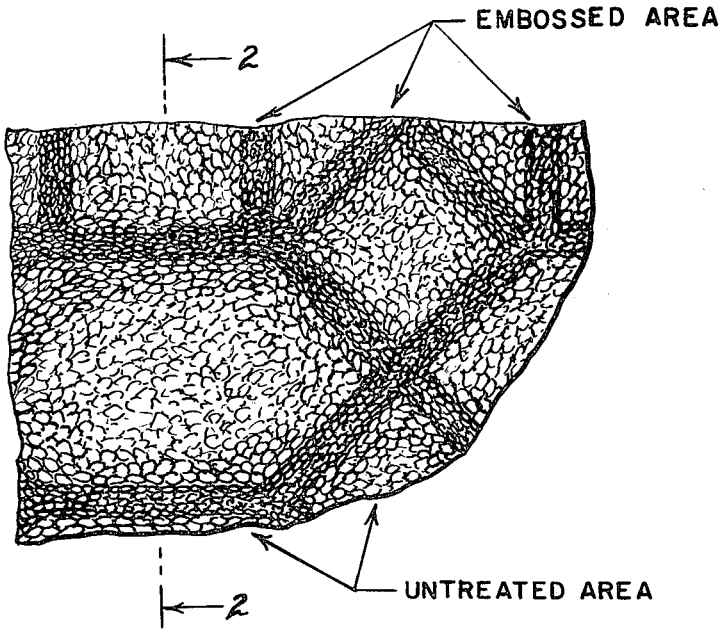
Figure 2:
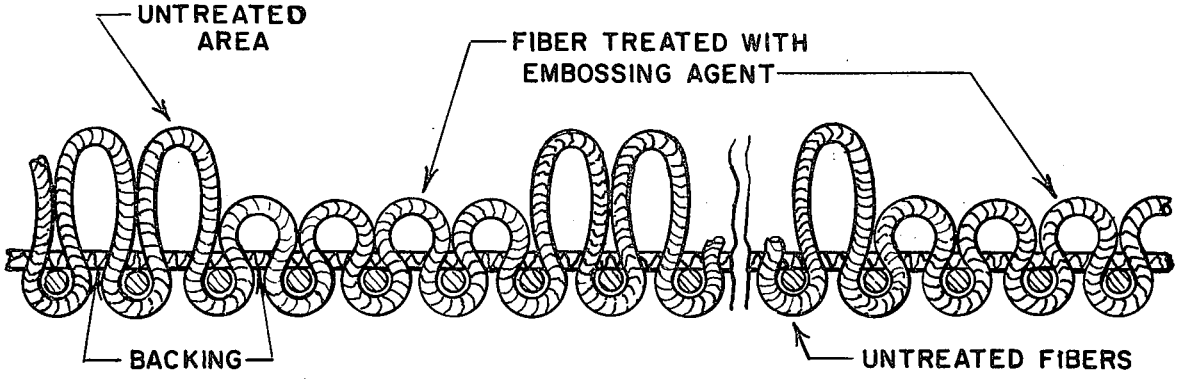

In the product of the pile fabrics of this invention, the pile yarn employed is nylon. Synthetic fibers prepared from polyamides or nylons are well known to those skilled in the art and as these terms are employed herein are intended to include any long chain synthetic polymeric amide which has recurring amide groups as integral part of the mainpolymer chain and which is capable of being formed into a filament in which the structural elements are oriented in the direction of the axis of that chain.

Polyamide resins coming within this definition and contemplated in the practice of the present invention are formed generally by reaction of the dicarboxylic acid with a diamine or by the self-condensation of an aminocarboxylic acid. Illustrative of these polyamide resins are nylon 66, prepared by the condensation of hexamethylenediamine and adipic acid; nylon 610 prepared from hexamethylenediamine and sebacic acid, both of the foregoing having, as prepared, molecular weights of approximately 20,000 to 50,000 or more; nylon-6 produced by thermal polymerization of epsilon-aminocaproic acid or caprolactam; nylon-11, the self-condensation production of 11-aminoundecanoic acid; as well as a variety of polymers prepared from polymerized, dibasic acids and polyamine compounds.

The practice of the present invention has, however, particular application to the solid, the orientable fiber-forming polyamides and more particularly to fibers and filaments prepared therefrom which have a denier and tenacity appropriate, and well known to those skilled in the art, for use in carpets, rugs, tapestry and the like. Illustrative of these polyamides are those having a filament denier of 1 to 630 or higher or nylon yarns in the denier range of 150 to 10,000 or higher. The tenacities of nylon yarn for use herein are within the range of 4.5 to 8 grams per denier. The elongation of drawn yarns can vary from 12 percent to about 100 percent or 200 percent, and depending on the application, undrawn yarn is capable of being elongated up to 400 percent to 500 percent or more. It is understood additionally that encompassed within the polyamides that can be employed in the practice of this invention are high molecular weight synthetic linear polyamides, in addition to those described hereinabove, that have been modified, for example, to enhance their usefulness for particular application. Illustrative of the foregoing are the polyamides described in U.S. Pat. Nos. 3,184,436 and 3,560,448 where the dyeability of the polymers is enhanced, for example, by the inclusion of sulfonic acid moieties in the polymer molecule.

An extended discussion of polyamides of sufficiently high molecular weight to be capable of being melt spun into filaments and coming within the contemplation of this invention appears in D. E. Floyd, Polyamide Resins, Reinhold Plastics Application Series (2d Printing 1961), and H. R. Mauersberger, Matthews' Textile Chemical Properties (6th ed. 1954).

Likewise the embossing agents and penetrants which are applied to the nylon fibers in order to produce the desired effect are also known chemical compounds. For purposes of this invention, the term "embossing agent" is defined as any active chemical or combination of chemicals which when applied to the pile fabric produces a measurable reduction of pile height, but without serious deterioration of the nylon fibers. In fact, it is our objective to induce embossment and shrinkage without deteriorating the fiber.

Embossing compositions, for the purpose of the description appearing herein, embrace those combinations of embossing agents, penetrants and such other components and additions as may be conventionally present in compositions for use in the printing of nylon pile fabric.

The exact chemical and physical mechanism by which the embossing and shrinking effects of this invention are achieved is not completely understood. However, it is believed that the embossing agent may owe its effectiveness largely to its capability to function as a hydrogen bond breaker. Initially, fibers are in a stretched crystalline state. When the hydrogen bond is broken between the polymer chains, the fibers relax and shrink. Regardless of the mechanism, the overall effect produced is one of dimensional change, the most desirable effect, involving linear contraction of the fiber.

The depth of penetration into the pile attained by the embossing agents is of obvious importance, since to secure shrinking and consequent embossing of selected areas of the pile, the embossing agent must be brought into contact with as much of the length of the individual fibers forming the pile as possible, and in such a manner as to enable the shrinking operation to be completed as quickly as possible consistent with conventional printing techniques.

In order to be applicable for the novel process of this invention, the embossing agent and penetrant should provide a reduction of the pile height through a shrinkage reaction, should not adversely affect the printing means, e.g., print screens, and should be capable of being substantially removed or inactivated subsequent to the embossing action. Other characteristics of the embossing composition which are desirable, though not essential, include compatibility with dye print pastes, capability of being regulated by factors of time, temperature, and concentration, i.e. susceptibility to activation by a conventional steaming operation and exhibiting no residual embossing activity. Needless to say, minor adjustments in the nature of the components and process conditions, and/or the embossing apparatus can be employed to overcome the absence of certain of these desired characteristics.

The embossing composition for use of the fibers of nylon pile fabric is applied to the ends of the pile fibers remote from the base to which they are secured in any desired design, whether it be random or predetermined. One of the easiest methods of applying the embossing composition is by utilizing conventional printing technique such as silk screen, printing rolls, or block printing. The embossing agent is applied as part of a transparent vehicle, or as part of a dye composition utilized for pile fabric printing. Among such applicable vehicles are included water and alcohols such as methanol and isopropanol. Often thickeners, e.g., gums, and cellulose derivatives, are included in order to obtain viscosity characteristics demanded in print technology and to enable the embossing agent to adhere to and operate on the synthetic fiber and to hold the printed patterns.

In those instances where it is desired to achieve a single — or multi-colored printed decoration with a distinct color for the embossed area, the embossing agent can be incorporated into a particular dye or pigment composition. The dye or pigment will be generally in the form of a printing paste ink to which the appropriate amount of agent is added. It is to be noted that in preparing these modified dye compositions, the pH levels, viscosities, and dye concentration which are essential to an efficient dyeing operation must also be controlled. The resultant effect is an embossed design in register with the printed pattern.

The embossing agent is normally in solution when applied to the selected areas of the fabric. All of the embossing composition's components need not be in solution. However, they should be in the embossing composition in a form at least sufficiently finely divided to pass through the print screen, that is, they must not only pass through a screen but must past through freely. The purpose of this, of course, is to make sure that the agent become uniformly dispersed over the fiber in the print process so that the shrinking effect will be uniformly developed in the fiber.

As previously indicated, the preferred embossing agent is one which is dormant during the successive printing operations but that is activated by elevated temperatures and preferably by treatment in a steam chamber normally utilized to fix the dye onto the fibers in a conventional printing operation. Embossing agents which can function in this manner on nylon and produce shrinkage of the nylon fibers comprise acids having a dissociation constant no stronger than that of maleic acid and which are employed in an amount sufficient to induce a hydrogen ion concentration equivalent to a pH of no more than 4. Illustrative, and indeed preferred, among the acids for use herein, are phosphonic aicd, maleic acid, (MCA) monochloroacetic acid, and formic acid.

The penetrants employed in combination with the foregoing acids are characterized by the following general formulae:

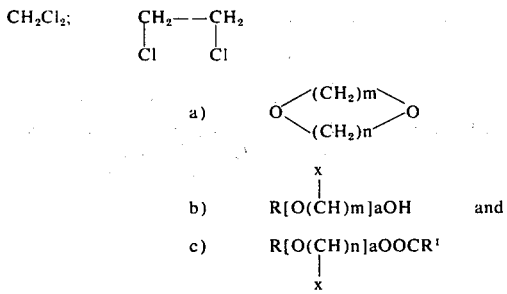

wherein each of m and n is an integer of up to 4; $a$ = 1,2,3 4; $x$ — H or $CH_3$, inclusive, and each of R and $R^1$ is a lower alkyl radical, that is an alkyl moeity of about 1 to 5 carbon atoms. Illustrative of the preferred penetrant solvents coming within the foregoing formulae are dioxane (diethylene dioxide), ethylene glycol monomethyl ether acetate (methyl cellosolve acetate) and diethylene glycol monobutly ether (butyl carbitol). Certain chlorinated hydrocarbons such as methylene choride or 1,2 - dichloroethane also act as penetrants.

The penetrants are employed in a concentration of about 20 percent to forty percent of the total embossing composition applied to the carpet or other pile fabric. The preferred concentration to achieve satisfactory embossing is within the range of twenty percent to thirty percent and most desirably about 25 percent.

The acids employed according to the invention are preferably phosphonic acid, maleic acid, monochloroacetic acid and formic acid. These acids are effective without the use of penetrants at significantly higher concentration to effect shrinking (without hydrolysis or oxidation of the nylon), when they are employed in a hydrogen ion concentration, such as described above. When a penetrant is used operative concentrations of phosphoric acid, maleic acid, and formic acid are normally about 40 percent to 50 percent by weight of the total embossing composition. Preferred amounts within this range are generally about 45 percent to 48 percent.

The advantages of this type of embossing composition are that embossing can be effected with the parameters of operation of the standard printing operation, particularly with respect to time, and using identical equipment. Since the quantities of acid employed are normally reduced, so are the toxicity and waste disposal problems and corrosion.

Embossing is achieved at a temperature of from 212° to 248°F by subjecting the treated fabrics to heat from any of a variety of sources such as by steaming or by infra-red radiation of a heated drum or coil, while normally exposed to an atmosphere of steam. The duration of exposure of the pile fabric to elevated temperatures is about 1 to 10 minutes and preferably about 2 to 4 minutes. Even though the steaming operation may not be essential to activation of the embossing agent, it will tend to increase the penetration of the embossing agent and result in less deterioration of the fiber.

The degree of diminution of the height of the pile is influenced by factors other than the specific embossing agents, penetrants or concentration of each, or the period of time during which embossing occurs (as measured by residence time in the steaming chamber or during which the fabric bearing the embossing agent is subject to heat from other sources.) These other factors include the amount of embossing compositions employed, of course, and the temperature at which embossing is effected, as well as the physical and chemical properties of the pile fibers and even the concentration of fibers in the pile.

While the depth of embossing will be determined by the practitioner in accordance with the type of embossed product being prepared, reduction in pile height will generally not exceed more than about 50%, this value being indicative of excellent embossing without exposing the backing materials.

A critical step in the novel process of this invention involves terminating the embossing action and/or effecting substantial removal of the embossing agent and residual penetrant from the pile fabric. It may be necessary to achieve elimination of all residues of the compounds used in the embossing process which may contribute undesirable properties to the finished fabric, such as odor, toxicity, color or texture change. Needless to say, any termination techique resorted to will depend on the particular embossing composition employed. The most useful technique for removing residues of the embossing process is by thoroughly washing the fabric with water and detergents. In those instances where the embossing agent is part of a dye or pigment composition, the washing cycle which is utilized to remove excess dye or pigment serves also to remove the traces of the agent. It is possible to halt the embossing action more rapidly by rinsing with an aqueous ammonia or mildly alkaline solution. This neutralization of the acid serves to insure the total removal thereof.

Other techniques for terminating the embossing action and/or removing the embossing agent may include evaporation and dry cleaning. Thus, if the agent is volatile, steaming of the treated pile fabric will serve to evaporate a large portion of the embossing agents. Where rinsing techniques are not effective, it may be necessary to resort to a dry cleaning procedure to remove the embossing residues.

The invention has particular application to tufted carpets which are to have a printed decoration applied thereon. Unusual design effects can also be obtained when the pile fabric is printed with a multi-colored design wherein one or more of the dye compositions contains the appropriate embossing agent. The process of printing such carpets includes the steps of passing tufted carpets with unpigmented or colored fibers into a screen printing apparatus whereby a design is printed on the carpet. Each screen applies a separate color to make up the final design. The embossing agent can be added to one or more of these printing stations by addition to the dye composition, or it can be applied by a separate station in a transparent vehicle. The fabric is then passed into a steaming chamber to set the dyes and cause embossing and then to a washing cycle which serves to remove excess dye as well as to terminate the embossing action and remove the embossing components.

Accordingly, in the embossing of carpet or textured pile fabric, and for all practical purposes we are discussing the embossing of carpeting, it is important that any color design on the surface of the carpet which is related to the embossing be in accurate register with the embossing. Since we are concerned only with chemical embossing the problem is then one of inducing the differential fiber length between the embossed colored areas and unembossed areas and, while it is possible to induce shrinkage of synthetic nylon fibers, it is necessary for preparation of the carpet that the fiber shrinkage be induced with no serious deterioration of what is left. Thus, if the operation of embossing involves true shrinkage the shrunk fiber should have a texture approximating that of the original.

In order to determine the parameters to be employed with a particular embossing agent and a specific nylon pile, the chemical system at various concentrations is incorporated in a dye printing paste and applied to a section of the nylon carpet by means of a screen printing technique so as to simulate plant production procedure as closely as possible. The treated carpet sample is steamed for 15 minutes at 215°-230°F., (102° - 110°C) thoroughly rinsed with water and dried. The depth of embossment is then measured and observations made regarding the character of the embossed nylon, e.g., strength, brittleness, softness, definition, color. Measurement of the pile height at the embossed and unembossed areas is made by means of a thin, steel ruler marked off at 1/64 inch (0.4 millimeter) intervals. Any method of measurement is useful so long as it is standardized from operation to operation and is reproducible to about 1/64 inch.

For a preliminary determination with respect to a particular embossing composition in effecting shrinking of nylon fibers and for thus determining its potential suitability as a chemical embossing agent for nylon carpet, we have devised a simpler, less time consuming test.

We believe that the breaking of intermolecular bonds is the basic mechanism involved both in the shrinking and in the dissolving of the nylon fiber by the chemical compounds. Thus, in selecting the most probable combination of shrinking compounds from a large number of prospective acids and penetrant vehicles, the solubility of nylon yarn in the chemical composition at a preselected temperature was adopted as a simple and fast test.

The procedure was as follows: 20–30 ml. of several concentrations of the chemical compositions to be tested as a solvent for the nylon fiber was heated in a bath thermostated at the testing temperature of 212°F. 2 to 3 inches of nylon yarn was immersed in this solution after it attained the test temperature. The dissolving effect of the test solution on the nylon yarn was observed up to the maximum 30 minute testing time and the time it took to fully dissolve the yard was recorded in seconds or minutes.

The following examples are further illustrative of the invention. In these examples, as well as in the remainder of the specification, all references to "parts" or "percentages" are references to parts or percentages by weight, unless otherwise expressly indicated.

EXAMPLE I

This example illustrates the comparative effectiveness of phosphoric acid as a prospective embossing agent with a penetrant, according to the invention.

TABLE I

| RUN NO. | | PENETRANT 25 (wt. %) | H3PO4 Concentration (wt. %) | | | | | | | | |
|---|---|---|---|---|---|---|---|---|---|---|---|
| | | | 64 | 55 | 52 | 51 | 50 | 49 | 45 | 43 | 40 |
| 1 | (70) | None | D2.5m | | | | | | | | |
| 2 | (72) | None | | D3m | | | | | | | |
| 6 | (104-12) | None | | | D12m | | | | | | |
| 7 | (103) | None | | | | PD | | | | | |
| 8,9 | (71) (102) | None | | | | | PD-ND | | | | |
| 10 | (109) | dioxane | | | | | D25s | | | | |
| 11 | (110) | dioxane | | | | | | D15s | | | |
| 12 | (111) | dioxane | | | | | | | D17s | | |
| 13 | (112) | dioxane | | | | | | | | D50s | |
| 14 | (113) | dioxane | | | | | | | | | MD |
| 15 | (114) | Meth. Cellosolve Acetate | | | | | | | | | D20-25s |

TABLE I-continued

| RUN NO. | | PENETRANT 25 (wt. %) | H3PO4 Concentration (wt. %) 64 | 55 | 52 | 51 | 50 | 49 | 45 | 43 | 40 |
|---|---|---|---|---|---|---|---|---|---|---|---|
| 16 | (115) | Bu-Carbitol | | | | | | | | | D35s |

Abbreviations:
D = dissolved;
PD = partially dissolved;
MD = most dissolved;
ND = not dissolved (in 30 minutes at 212°F);
Dxs = dissolved in x seconds at 212°F;
Dxm = dissolved in x minutes at 212°F
(The foregoing abbreviations are used in Tables II and III as well)

It was found that a high concentration, i.e., 40 to 50 percent; of phosphoric acid in a 25 percent solution of the penetrants (by weight of the total embossing composition) according to the invention dissolved nylon 66 normally in no more than 35 seconds as contrasted with the several minutes required for higher concentrations of the same acid where no penetrant was employed. The higher concentrations of acid are those that would have to be employed to secure any embossing without the use of a penetrant vehicle.

EXAMPLE II

This example illustrates the effect of the penetrants according to the invention using maleic acid as the prospective embossing agent.

TABLE II

Effect of Penetrants on Nylon 66 Solubility in Maleic Acid

| Run No. | | Penetrant Wt. 25% | Wt. % Maleic Acid Concentrations 50 | 45 | 40 |
|---|---|---|---|---|---|
| 17-18 | (1,2) | None | PD-D | | |
| 19 | (7) | None | | 45 | |
| 20-21 | (5) (11) | Dioxane | | ND | |
| 22 | (15) | Dioxane | | 10 seconds | |
| 23 | (85) | Methyl Cellosolve Acetate (Ethylene glycol methylether acetate) | | | M.D. |
| 24 | (87) | Bu-Carbitol (diethyleneglycolmonobutyl ether) | | | P.D. |
| 25 | (89) | Solvent LM (isopropylglycol monomethyl ether) | | | P.D. |
| | | | | | N.D. |

It was found that a high concentration, i.e., 40 percent to 50 percent of maleic acid in a 25 percent solution (both by weight of the total embossing composition) of penetrant vehicle, coming within the scope of the present invention, dissolved nylon 66 materially. This is contrasted with those instances where no penetrant vehicle or agents was employed.

EXAMPLE III

This example illustrates the effect of the penetrants according to the invention using formic acid as a prospective embossing agent.

TABLE III

| Run No. | | Penetrant (25 Wt. %) | Formic acid concentrations (Wt%) 50 | 48 | 45 | 40.5 |
|---|---|---|---|---|---|---|
| 26 | (17) | None | ND | | | |
| 27 | (21) | Dioxane | D25s | | | |
| 28 | (23) | Dioxane | | MD | | |
| 29 | (27) | Dioxane | | | PD | |
| 30 | (59) | Cellosolve acetate | | | D20s | |
| 31 | (60) | Solvent LM | | | D20s | |
| 32 | (61) | Bu-Carbitol | | | D15s | |
| 33 | (62) | Cellosolve acetate | | | | PD |
| 35 | (63) | Solvent LM | | | | PD |
| 37 | (64) | Bu-Carbitol | | | | PD |

It was found that a strong concentration of up to 50 percent of formic acid in a 25 percent solution (by weight of the total embossing composition) solution of penetrant vehicle, coming within the scope of the present invention, dissolved nylon 66 materially as contrasted with those instances where no penetrant was employed.

The foregoing examples demonstrate the efficacy of the contribution represented by the present invention. The ready dissolution of the nylon fiber under the conditions defined for the test-tube solubility test of Tables 1-3 indicate that the penetrant vehicle of the invention qualify the acids described herein as most probably embossing or shrinking agents for nylon pile at reduced concentrations where the results of test tube solubility tests are trasposed to conditions of actual embossing of nylon carpet or other nylon pile fabric.

It must be emphasized that in a search for the embossing compound the solubility test serves only as a simple and fast screening method, which enables one to select the most probable from a large number of prospective shrinking compositions. A positive solubility test result, however, does not mean that a given chemical compounds or a combination of chemical compounds will be an effective embossing agent, or that the concentrations used in solubility test can be used in making an effective embossing paste.

An example that a chemical compound capable of dissolving the nylon yarn is not necessarily a good embossing agent is formic acid. A rapid transition from inadequately embossing at 54% concentration to being destructive to the carpet pile at 56% concentration makes formic acid unsuitable for embossing nylon carpet, despite the fact that formic acid is known to be a good solvent for nylon fiber.

Another example is formic acid-dioxane mixed solvent at 45%/25% and at a 48%/25% formic acid/dioxane concentrations. According to the solubility test results these two pairs are weak solvents for the nylon fiber. However, embossing pastes containing formic acid-dioxane at the above concentrations reduced the original pile height of the nylon carpet by 57% and caused an extensive damage to the fiber strength.

An actual embossing procedure must be used, involving the preparation of the embossing pastes, printing, steaming, washing and drying the embossed sample of the nylon carpet in order to select a real shrinking compound from a group of most probable shrinking agents previously determined by the solubility tests.

Following are two examples of embossing paste preparations, embossing conditions and the embossing tests results, in which the effect of non-acid additiives (penetrants) on the effectiveness of the embossing paste are compared with the effectiveness of the embossing paste without the penetrants.

| Embossing Paste Compositions | 56% Formic Acid Embossing Paste | 45% Formic Acid + 15% Cellosolve Acetate Embossing Paste |
|---|---|---|
| Polygum 260 (5% solid), thickener | 180 | — |
| Kelzan (5% solid), thickener | — | 120 |
| Formic Acid (90%) | 560 | — |
| Formic Acid (97%) | — | 272 |
| Ciba Phasol AS, surfactant | 3 | 2 |
| Water | 157 | 144 |
| Cellosolve Acetate (penetrant) | — | 92 |
| Total | 900 gr. | 600 gr. |
| Viscosity | 800 cps. | 7,400 cps. |
| Application: Steel double Roll applicator | 6 strokes | 4 strokes |
| Steaming: 15 min. at | 200°F | 232°F |
| Washing: Four washings, four wringings. | | |
| Fabric: 28 oz./yd.$^2$ ½ inch pile height, plush nylon carpet | | |
| Amount of Embossing: (pile height reduction) | 43% | 49% |

TABLE VI

Embossing Pastes - Containing Monochloroacetic Acid

| Paste Composition | Pile Height Reduction (%) | Paste composition | Pile Height Reduction (%) | Paste Composition | Pile Height Reduction (%) |
|---|---|---|---|---|---|
| 50% MCA | 50 | 30% MCA - 25% Ethylene dichloride | 50 | 30% MCA - 25% Dichloro methane | 44 |
| 48% MCA | 44 | 25% MCA - 30% Ethylene dichloride | 44 | 25% MCA - 30% Dichloro methane | 31 |
| 45% MCA | 38 | 25% MCA - 25% Ethylene dichloride | 38 | 25% MCA - 25% Dichloro methane | 31 |
| 43% MCA | 31 | | | | |

TABLE V

Embossing Pastes Containing Formic Acid

| Paste Composition | Pile Height Reduction (%) | Paste Composition | Pile Height Reduction (%) | Paste Composition | Pile Height Reduction (%) |
|---|---|---|---|---|---|
| 56% Form. acid | 43 | 50% Form. acid 5% dioxane | 29 | 45% Form. acid 25% Ethylene dichloride | 57* |
| 54% Form. acid | 38 | 50% Form. acid 3% dioxane | 21 | 45% Form. acid 15.5% Ethylene dichloride | 56* |
| 52% Form. acid | 29 | 48% Form. acid 15% dioxane | 57* | 43% Form. acid 16% Ethylene dichloride | 50 |
| 50% Form. acid. | 21 | 48% Form. acid 10% dioxane | 36 | 40% Form. acid 16% Ethylene dichloride | 38 |
| | | 48% Form. acid 5% dioxane | 21 | 45% Form. acid 15% Butyl Cellosolve | 56 |
| | | 45% Form. acid 25% dioxane | 57* | 45% Form. acid 15% Butylcarbitol | 49 |
| | | 45% Form. acid 15% dioxane | 44 | 45% Form. acid 15% Cellosolve | 49 |

TABLE V-continued

| Embossing Pastes Containing Formic Acid | | | | | |
|---|---|---|---|---|---|
| Paste Composition | Pile Height Reduction (%) | Paste Composition | Pile Height Reduction (%) | Paste Composition | Pile Height Reduction (%) |
| | | | | acetate | |

*=Yarn weakened

Concluding Summary:

In recapitulation it is to be observed that the formulations described in detail herein, using acids for the embossment of pile fabrics, are generally improved by the inclusion with the formulation of a penetrating agent. Similarly, the formulations described in copending applications, which have been identified herein as Related Applications, assigned to the same Assignee, also can have their properties enhanced by the inclusion of such penetrating agents.

In the selection of the penetrant, it should be noted that there are two types which are identified in the basic disclosure herein.

The one is a recoverable penetrant, namely, the chloroinated hydrocarbon materials. These include the chlorinated hydrocarbons having 1, 2, 3, 4, or even 5 carbon atoms, with at least one chlorine per carbon atom. Specifically preferred of course, are methylene dichloride, 1,5,3-dichloropropane, or ethylene dichloride. The chlorinated hydrocarbons types are of course preferred because they are immiscible in water, and consequently are easily recoverable by flooding the wash water from the carpet with additional water and separating off the chlorinated hydrocarbon. Recovery of very volatile materials is easily accomplished by heating the wash water to volatilize them and merely condensing this vapor.

The penetrants belonging to the alcohol and ether groups of which we have given a few examples, have some advantage; especially where it is not desired to recover them, because the disposal problem is relatively easy. They are bio-degradable and thus are simply disposed of.

Thus, polyalkylene oxide type, lowest member of the series being dioxane, and higher members being cyclic-polyethylene oxides are water soluble and directly disposable.

Polyethers with a terminal alcohol include polyethylene oxide, polypropylene oxide, polybutylene oxide.

There are also those which end in an ester group, rather than a hydroxyl group.

Thus the families of penetrants which have been identified by general formula herein, include those compounds of these two general types which are useful for their qualities in helping the agent penetrate and for whatever additional property the operator may desire to develop in terms of recovery or disposibility of the agents from the process.

Summary:

1. It seems that 50% pile height reduction by the chemical embossing of the nylon carpet is about the maximum limit at which the embossed pile retains its original strength. A somewhat larger than 50% pile height reduction causes weakening of the pile yarn, regardless of the chemical compound used for the embossing.

2. Incorporation of certain non-acid additives (penetrant vehicle) into embossing paste makes possible:

a. Considerable reduction in the concentration of the embossing agents without affecting the effectiveness of the embossing paste.

b. Broadening the effective concentration range of the embossing agents. (Concentration range is defined as that range which is limited by the minimum concentration of the embossing compound necessary to induce the shrinkage and by the maximum concentration of the embossing compound at which the embossed pile begins to lose its strength).

c. Reduction of equipment corrosion by reducing the concentration of acid type embossing compounds in the paste.

d. By a simple method to recover and recycle certain (water insoluble chlorinated hydrocarbons e.g., ethylene dichloride) additives (penetrant vehicles) and thus reduce the raw material costs.

It will be evident that the terms and expressions which have been employed are used as terms of description and not of limitation. There is no intension in the use of such terms and expressions of excluding equivalents of the features shown and described or portions thereof and it is recognized that the various modifications are possible within the scope of the invention claimed.

What is claimed is:

1. Process for providing an embossed effect on nylon pile fabric having a surface of nylon fibers which comprises applying to defined areas of the pile surface of said fabric a chemical embossing composition for said fibers containing an embossing agent and a penetrant therefor, said embossing agent including an acid having a dissociation constant no stronger than that of maleic acid and said composition having a hydrogen ion concentration equivalent to a pH of no more than 4;

said penetrant corresponding to a compound selected from:

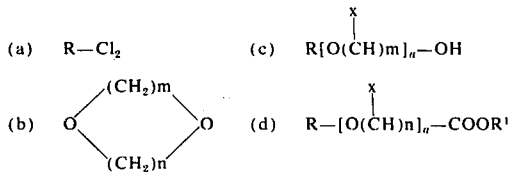

wherein each of *m*, *n*, and *a* is an integer from 1 to 4 inclusive, X=H or $CH_3$ and each R and $R^1$ is a lowe alkayl radical of 1 to 5 carbon atoms allowing said embossing composition to remain ir contact with said fibers for a period of time and a a temperature sufficient to reduce the height o said pile only in the area contacted by said emboss ing composition, without deterioration of said fibers, said reduction being sufficient to display a significant embossed effect in the overall fabric.

2. The process of claim 1 wherein said penetrant is present in an amount by weight of 20 percent to 40 percent of the total embossing composition.

3. The process of claim 1 wherein said penetrant is present in an amount by weight of 25 percent of the total embossing composition.

4. The process in accordance with claim 2 wherein said embossing action occurs within 4 minutes at a temperature of at least 212°F.

5. The process of claim 2 wherein said penetrant is dioxane.

6. The process of claim 2 wherein said penetrant is diethylene glycol butyl ether.

7. The process of claim 2 wherein said penetrant is ethylene glycol monomethyl ether acetate.

8. The process of claim 4 wherein said embossing agent is present in a concentration of 40 percent to 50 percent by weight of total embossing composition.

9. The process of claim 8 wherein said embossing agent is phosphoric acid.

10. The process of claim 8 wherein said embossing agent is maleic acid.

11. The process of claim 8 wherein said embossing agent is formic acid.

12. The process of claim 4 wherein said embossing composition is incorporated in a transparent vehicle therefore.

13. The process of claim 4 wherein said embossing effect is made in register with a printed color design on said fabric, and said vehicle is a dye printing paste carrying said embossing agent.

14. The process of claim 4 wherein said embossing action occurs in a steam environment.

* * * * *